United States Patent [19]

Stehlin et al.

[11] Patent Number: 4,725,281

[45] Date of Patent: Feb. 16, 1988

[54] AQUEOUS ALKALINE, SILICATE-CONTAINING COMPOSITION AND THE USE THEREOF FOR BLEACHING CELLULOSIC FIBER MATERIALS IN THE PRESENCE OF PER COMPOUNDS

[75] Inventors: Albert Stehlin, Rosenau, France; Christian Guth, Basel, Switzerland

[73] Assignee: Ciba-Geigy Corporation, Ardsley, N.Y.

[21] Appl. No.: 884,253

[22] Filed: Jul. 10, 1986

[30] Foreign Application Priority Data

Jul. 19, 1985 [CH] Switzerland ..... 3141/85

[51] Int. Cl.[4] ..... D06L 3/02; C11D 7/54

[52] U.S. Cl. ..... 8/107; 8/111; 252/186.26; 252/186.29; 252/186.38; 252/186.41; 252/186.27; 252/95; 252/99; 252/102; 252/103; 252/156; 252/535; 252/539; 252/353

[58] Field of Search ..... 8/107, 111, 116.1; 252/95, 99, 102, 103, 186.26, 186.27, 186.28, 186.29, 186.31, 186.41, 156, 526, 524, 527, 535, 539, 353

[56] References Cited

U.S. PATENT DOCUMENTS

| | | | |
|---|---|---|---|
| 2,838,459 | 6/1958 | Sprout | 252/186.28 |
| 2,927,082 | 3/1960 | Young | 252/186.29 |
| 3,514,247 | 5/1970 | Lawes et al. | 8/111 |
| 3,766,078 | 10/1973 | Kowalski | 252/99 |
| 3,795,625 | 3/1974 | Kowalski | 252/186.26 |
| 3,860,391 | 1/1975 | Kling et al. | 8/111 |
| 3,951,594 | 4/1976 | Smolens | 8/111 |
| 3,996,151 | 12/1976 | Kirner | 252/99 |
| 4,079,015 | 3/1978 | Paucot et al. | 252/95 |
| 4,337,214 | 6/1982 | Rohlfs et al. | 8/111 |
| 4,347,149 | 8/1982 | Smith et al. | 252/102 |
| 4,363,699 | 12/1982 | De Ceuster et al. | 8/111 |
| 4,384,970 | 5/1983 | Tourdot et al. | 252/99 |
| 4,496,472 | 1/1985 | Schäfer et al. | 252/186.22 |
| 4,515,596 | 5/1985 | Berendt et al. | 8/107 |

FOREIGN PATENT DOCUMENTS 2396114 1/1979 France .

OTHER PUBLICATIONS

CA Abstracts, vol. 90, 1979, 139028s.

*Primary Examiner*—Prince E. Willis

*Attorney, Agent, or Firm*—Edward McC. Roberts

[57] ABSTRACT

A novel aqueous composition which comprises (a) an aminopoly(alkylenephosphonic acid), an alkanepolyphosphonic acid and/or an alkali metal salt of a polyaminocarboxylic acid, (b) a polyhydroxy compound, (c) an alkali metal silicate, (d) an alkali metal hydroxide, (e) a magnesium salt, and (f) an alkali metal salt of an alkyldisulfonic acid, aryldisulfonic acid or alkaryldisulfonic acid as anionic dispersant.

The composition is storage stable and is particularly suitable for use as bleaching activator and bleaching stabilizer for the pretreatment of cellulosic fibre materials with a bleaching liquor that contains a per compound.

20 Claims, No Drawings

AQUEOUS ALKALINE, SILICATE-CONTAINING COMPOSITION AND THE USE THEREOF FOR BLEACHING CELLULOSIC FIBER MATERIALS IN THE PRESENCE OF PER COMPOUNDS

The present invention relates to an alkaline, silicate-containing composition comprising a polymeric aminophosphonic or aminocarboxylic acid, a polyhydroxy compound, a magnesium salt and, as anionic dispersant, e.g. an alkyldisulfonic acid, aryldisulfonic acid or alkaryldisulfonic acid, and to the use of said composition for bleaching cellulosic fibre materials in the presence of e.g. hydrogen peroxide.

An alkaline, peroxide-containing, silicate-free composition comprising a polymeric aminophosphonic or aminocarboxylic acid, a polyhydroxy compound and, as optional component, a nonionic or anionic dispersant, e.g. an alkylarylmonosulfate, which composition is used for bleaching cellulosic fibre materials, is disclosed in U.S. Pat. No. 3,860,391. This known composition, which contains an alkylarylmonosulfate as optional component, is not sufficiently storage stable at high pH values, e.g. from 13 to 14. In addition, the concurrent use of silicates for bleaching cellulosic fibre materials entails the acceptance of a high ash content of the bleached materials.

It has now been found that these shortcomings can be substantially overcome by using a composition which always contains an alkyldisulfonic acid, aryldisulfonic acid or alkaryldisulfonic acid, or a salt thereof, as anionic dispersant.

Accordingly, the present invention relates to an aqueous composition which comprises (a) an aminopoly(alkylenephosphonic acid), an alkanepolyphosphonic acid and/or an alkali metal salt of a polyaminocarboxylic acid,
(b) a polyhydroxy compound,
(c) an alkali metal silicate,
(d) an alkali metal hydroxide,
(e) a magnesium salt, and
(f) an alkali metal salt of an alkyldisulfonic acid, aryldisulfonic acid or alkaryldisulfonic acid as anionic dispersant.

Further objects of the invention are:

a process for the preparation of the composition,
the use of said composition as bleaching activator and bleaching stabiliser in aqueous liquors that contain a per compound for pretreating cellulosic fibre materials,
a process for bleaching cellulosic fibre materials which comprises treating said materials with an aqueous liquor that contains a per compound and the composition of the invention,
an aqueous liquor for carrying out said process, which liquor contains a per compound and the composition of the invention, and
the cellulosic fibre material bleached by the process of the invention.

The aminopoly(alkylenephosphonic acid) which may be suitably employed as component (a) of the composition of this invention is preferably an aminobis($C_1$–$C_3$ alkylenephosphonic acid), an aminotris($C_1$–$C_3$ alkylenephosphonic acid), a diaminotetra(methylenephosphonic acid) or triaminopenta(methylenephosphonic acid) which is derived from a saturated, aliphatic or cycloaliphatic hydrocarbon of 2 to 6 carbon atoms. The alkanepolyphosphonic acid suitable for use as component (a) is preferably a $C_1$–$C_4$ alkanediphosphonic or -triphosphonic acid which is substituted by hydroxy, amino, $C_1$–$C_4$ alkylamino or $C_1$–$C_4$ dialkylamino. The alkali metal salt of a polyaminocarboxylic acid which may also be suitably used as component (a) is in particular the potassium salt, preferably the sodium salt, of a polycarboxylic acid containing 1 to 3 nitrogen atoms and 3 to 5 carboxymethyl groups or 1 carboxymethyl group and 2 hydroxyethyl groups.

Mixtures of polyphosphonic acids and alkali metal salts of the kind indicated above are also suitable for use as a component (a). In this case, it is preferred to use several polyphosphonic acids or preferably only one polyphosphonic acid or the alkali metal salt of several polycarboxylic acids or of only one polycarboxylic acid. Polycarboxylic acids in the form of their alkali metal salts are used alone as well as in admixture with polyphosphonic acids, whereas polyphosphonic acids are preferably used alone. The polyphosphonic acids are preferred to the alkali metal salts of polycarboxylic acids. The aminopoly(alkylenephosphonic acids) are preferred to the alkanepolyphosphonic acids.

$C_1$–$C_3$ Alkylene radicals of the aminobis- and aminotris($C_1$–$C_3$ alkylenephosphonic acids) are isopropylene, preferably ethylene and, most preferably, methylene. Examples of specific representatives of such polyphosphonic acids are: aminotris(isopropylenephosphonic acid), aminotris(ethylenephosphonic acid) and, in particular, aminotris(methylenephosphonic acid).

An aliphatic or cycloaliphatic hydrocarbon of 2 to 6 carbon atoms from which the diaminotetra(methylenephosphonic acids) and triaminopenta(methylenephosphonic acids) are derived are preferably cyclobutane, cyclopentane, cyclohexane and, most preferably, propane and ethane. Examples of specific representatives of polyphosphonic acids of this kind are:

bis(ethylenediamino)sulfidotetra(methylenephosphonic acid),
1,2-bis(aminomethyl)cyclobutanetetra(methylenephosphonic acid),
1-aminomethyl-2-aminocyclopentanetetra(methylenephosphonic acid),
1,2-diaminocyclohexanetetra(methylenephosphonic acid), 1,2- or
1,3-diaminopropanetetra(methylenephosphonic acid), in particular
1,3-diamino-2-hydroxypropanetetra(methylenephosphonic acid), preferably dipropylenetriaminopenta(methylenephosphonic acid) and, most preferably, diethylenetriaminepenta(methylenephosphonic acid).

Preferred alkanephosphonic- or -triphosphonic acids contain a n-propane or ethane radical which is substituted by amino or, preferably, hydroxy. Examples of specific representatives of polyphosphonic acids of this kind are: 1-hydroxypropane-1,1,3-triphosphonic acid, 1-aminoethane-1,1-diphosphonic acid, preferably 1-hydroxyethane-1,1,2-triphosphonic acid and, most preferably, 1-hydroxyethane-1,1-diphosphonic acid.

Preferred polyaminocarboxylic acids contain 1 to 3, preferably 2 or 3, nitrogen atoms and 4 or 5 carboxymethyl groups and are unsubstituted or substituted by a hydroxyethyl or hydroxyl group. Unsubstituted polyaminocarboxylic acids, however, are preferred. Examples of specific representatives of such polyaminocarboxylic acids are: N,N-bis(2-hydroxyethyl)glycine, nitrilotriacetic acid, preferably 1,3-diamino-2-propanoltetraacetic acid, N-hydroxyethylethylenediaminetetraacetic acid and, most preferably, ethylenediaminetetraacetic acid and diethylenetriaminepentaacetic acid, which acids are in the form of their alkali metal salts, preferably potassium salts and, most preferably, sodium salts.

Component (a) acts as complexing agent for alkaline earth metals and heavy metals when using the composition of this invention in aqueous liquors that contain a per compound, e.g. hydrogen peroxide, for pretreating, especially for bleaching, cellulosic fibre materials. In particular, component (a) inhibits the decomposition of the per compound in the bleaching liquor by free, i.e. non-complexed, heavy metals which may be present in the process water.

Component (a) is preferably added to the composition of the invention in the form of a 35 to 70% by weight, most preferably 40 to 60% by weight, aqueous solution.

If a polymeric aminophosphonic or aminocarboxylic acid is employed as component (a), it is at least partially hydrolysed to the corresponding monomer in the aqueous composition of the invention in the presence of an alkali metal hydroxide, both on storage as well as when used in bleaching liquors.

The polyhydroxy compound employed as component (b) in the composition of this invention is in particular a compound that contains at least 2 hydroxyl groups. Such a compound preferably corresponds to the formula

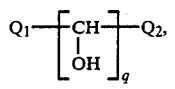

(1)

wherein each of $Q_1$ and $Q_2$ independently of the other is $-CH_2OH$, —CHO or —COOM, where M is hydrogen or an alkali metal, preferably potassium or, most preferably, sodium, and q is an integer from 2 to 5.

It is also preferred to use a hydroxycarboxylic acid of the formula

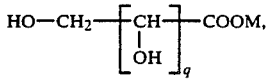

(2)

wherein M and q have the given meanings, or a lactone of such a hydroxycarboxylic acid. Examples of specific representatives of such hydroxycarboxylic acids are: gluconic acid and the alkali metal salts thereof, preferably the potassium salt or, most preferably, sodium salt, as well as the γ-lactone of gluconic acid.

Component (b) acts as complexing agent when using the composition of the invention in bleaching liquors for pretreating cellulosic fibre materials. This action is ensured even in bleaching liquors with pH values above 11. Component (b) is usually added in the form of a solid.

The alkali metal silicate employed as component (c) is normally water-soluble. Sodium silicate, which as commercial product preferably has an $SiO_2$ content of about 24 to 28% by weight, is particularly suitable. It is preferred to use a commercial aqueous solution of sodium silicate of about 30 to 40% by weight as component (c).

Component (c) permits longer treatment times in bleaching liquors for pretreating cellulosic fibre materials.

An alkali metal hydroxide which may be suitably used as component (d) is preferably potassium hydroxide or, in particular, the cheaper sodium hydroxide. In view of the homogeneity of the composition, a mixture of potassium hydroxide and sodium hydroxide is especially suitable for use as component (d). Component (d) is preferably added undiluted and in an amount of not less than 9%, based on the total weight of the composition. Accordingly, component (d) will preferably be in the form of solid potassium hydroxide or, preferably, solid sodium hydroxide and, most preferably, of a mixture of solid potassium and sodium hydroxide, with the weight ratio of sodium hydroxide to potassium hydroxide being in general from 1:0.01 to 1:2, preferably 1:0.05 to 1:0.25. The addition of component (d) gives strongly alkaline compositions having a pH value of $\geqq 14$. The alkalinity of the compositions by addition of larger amounts of component (d) is determined by the concentration of alkali metal hydroxide.

The magnesium salt employed as component (e) is e.g. in the form of the acetate, preferably sulfate or heptahydrate thereof, and is in particular the chloride or hexahydrate thereof. Component (e) is normally added as solid, and is preferably in the form of solid magnesium chloride hexahydrate. Component (e) forms with component (a) a water-soluble magnesium complex which acts as bleaching stabiliser. In particular, the presence of the magnesium complex formed by components (a) and (e) ensures that there is no loss, or at least a reduced loss, for some time in the original activity of the per compound, e.g. hydrogen peroxide, in the bleaching liquors containing the composition of the invention.

An anionic dispersant which may be suitably employed as component (f) is in particular the potassium or, preferably, sodium salt of an alkyldisulfonic acid, aryldisulfonic acid or alkaryldisulfonic acid which is used undiluted, e.g. as powder or paste or as an aqueous solution having a concentration of at least 40% by weight, preferably of 40 to 94% by weight. The alkyl moiety of the alkyldisulfonic acid in this case normally contains 8 to 20 carbon atoms. The disodium salt of pentadecane-1,8-disulfonic acid in the form of an aqueous 40 to 60% by weight solution is cited by way of example. An aryldisulfonic acid is preferably a derivative of naphthalenemonosulfonic acid which is preferably in the form of the condensate with formaldehyde, obtained by reacting 2 or 3 moles of naphthalenesulfonic acid with 1 or 2 moles of formaldehyde. Methylenebis(2,2'-naphthalene-7,7'-sodium sulfonate) in the form of an aqueous 80 to 95% by weight solution is cited by way of example. An alkaryldisulfonic acid which may also be suitably used as component (f) contains straight or branched alkyl chains of at least 4, preferably 4 to 22 and, most preferably, 4 to 18, carbon atoms. A preferred alkaryldisulfonic acid is e.g. a dodecylbenzenedisulfonic acid or a 3,7-diisobutylnaphthalenedisulfonic acid or, most preferably, a disulfonated benzylalkylbenzimidazole which preferably contains 8 to 22 carbon atoms in the alkyl moiety. It is particularly preferred to use e.g. the disodium salt of a 1-benzyl-2-heptadecylbenzimidazoledisulfonic acid, preferably in powder form. The alkali metal salt of the above disulfonic acids which is used as component (f) is an anionic dispersant that ensures the storage stability of the concentrated composition of this invention at high pH values of at least 13, preferably of 13 to 14.

The composition of this invention generally comprises 0.1 to 2.0, preferably 0.25 to 1.5% by weight of component (a),
0.4 to 8.0, preferably 1.50 to 5.0% by weight of component (b),
5.0 to 20.0, preferably 10.00 to 18.00% by weight of component (c),
9.0 to 21.0, preferably 10.00 to 16.0% by weight of component (d),
0.05 to 2.0, preferably 0.10 to 1.0% by weight of component (e),
0.5 to 3.0, preferably 0.75 to 2.5% by weight of component (f), and
44.0 to 84.95, preferably 56.0 to 77.40% by weight of water, based on the total weight of said composition.

The method of preparing the composition of this invention normally comprises adding half the total amount of component (d) to an aqueous solution (A) of components (c) and (f), then adding an aqueous solution (B) containing components (a), (b) and (e) to solution (A), and finally adding the remaining half of component (d) to the mixture of solutions (A) and (B). In this method, the aminopoly(alkylenephosphonic acid) or alkanepolyphosphonic acid employed as component (a) of solution (B) is converted by the remainder of component (d) into the corresponding alkali metal salt, e.g. the potassium or, preferably, sodium salt. The addition of component (d) in portions causes the reaction mixture to exotherm, so that external cooling may be necessary, e.g. at temperatures above 80° C. By controlling the rate of addition of component (d), the mixing of solution (A) with half the amount of component (d), then with solution (B) and, finally, with the remaining half of component (d) is preferably effected at a temperature not exceeding 80° C., preferably in the range from 60° to 70° C.

The above described procedure affords the material advantage that the addition of component (d) in two portions does not give rise to any undesirable precipitations during the preparation of the composition of this invention. In addition, solution (A) containing components (c) and (f) and solution (B) containing components (a), (b) and (e), which solutions are normally in the form of aqueous solutions, can be kept in stock owing to their excellent storage stability and can be processed at any time, as required, by addition of component (d) as described above to give the composition of the invention.

The bleaching liquors mentioned at the outset for carrying out the method of treatment using the composition of this invention contain, as per compound, e.g. an alkali metal persulfate, preferably potassium persulfate or, most preferably, sodium persulfate ($Na_2S_2O_8$), which is normally added undiluted, i.e. in solid form. However, the preferred per compound is hydrogen peroxide ($H_2O_2$), which on account of its high stability is normally used in the form of a concentrated solution (30 to 60% by weight).

Besides containing the composition of this invention and a per compound as mandatory components, the bleaching liquors may also contain wetting agents or dispersants, antifoams and/or deaerators and/or fluorescent whitening agents as optional components.

Wetting agents or dispersants are usually added to the bleaching liquors as optional components if the cellulosic fibre material to be treated is cellulose in the natural state or, in particular, consists of cotton in the natural state. Suitable wetting agents or dispersants are anionic or nonionic surfactants, preferably mixtures thereof. Preferred anionic surfactants are e.g. alkarylsulfonates, fatty acid condensates, protein fission products or salts thereof and, most preferably, alkylsulfate salts and alkylbenzenesulfonic acids containing 12 to 22 carbon atoms in the alkyl moiety. Preferred nonionic surfactants are e.g. adducts of alkylene oxide, in particular propylene oxide, and most preferably, ethylene oxide, with alkylphenols containing e.g. 12 to 14 carbon atoms in the alkyl moiety, preferably with fatty acid amides and, most preferably, with fatty alcohols. Adducts of ethylene oxide and fatty alcohols are especially preferred, with mixtures of such adducts with the alkylsulfates of the indicated kind being most preferred. Further suitable components in these mixtures are silicone surfactants or silicone oils.

Antifoams or deaerators are optional component but it is necessary to add them to the bleaching liquor if a wetting agent or detergent is present. Such antifoams and/or deaerators are e.g. higher alcohols, preferably isooctanol, but are preferably silicone-based antifoams and deaerators, especially silicone oil emulsions.

The fluorescent whitening agent added as optional component to the bleaching liquor to achieve a particularly high degree of whiteness on the materials to be treated will generally belong to the styryl or stilbene series, e.g. to the distyrylarylenes, diaminostilbenes, ditriazolylstilbenes, phenylbenzoxazolylstilbenes, stilbenenaphthotriazoles and dibenzoxazolylstilbenes. Preferred fluorescent whitening agents are those of the distyrylbiphenyl or bistriazinylaminostilbene types which contain sulfonic acid groups, e.g. sulfonated distyrylbiphenyl and distyrylbistriazinyl derivatives, preferably the bis(phenylaminomorpholino-s-triazinyl)stilbenedisulfonic acids in the form of alkali metal salts, especially potassium salts or, preferably, sodium salts. These are preferably added in the form of commercial aqueous 20 to 30% by weight liquid formulations.

In addition, especially if the treatment of the cellulosic fibre materials is not carried out by HT methods in the temperature range up to 150° C. under pressure, it is expedient to add an alkali metal hydroxide, preferably potassium hydroxide or, most preferably, sodium hydroxide, conveniently in the form of an approximately 30% by weight solution or in the form of solid potassium hydroxide or, in particular, of solid sodium hydroxide.

The aqueous bleaching liquors generally contain
0.5 to 15.0% by weight, preferably 1 to 12.5% by weight, of the novel aqueous composition,
0.2 to 5% by weight, preferably 0.7 to 3.5% by weight, of per compound,
0 to 0.1 to 1% by weight, preferably 0.1 to 0.5% by weight, of wetting agent or detergent,
0 to 0.5 or 0.05 to 0.5% by weight of antifoam or deaerator,
0 to 0.1 or 0.01 to 0.1% by weight of fluorescent whitening agent, and
0 to 1 or 0.1 to 1% by weight, preferably 0.2 to 0.7% by weight, of an alkali metal hydroxide,
based on the total weight of the bleaching liquor.

The process for bleaching cellulosic fibre materials with the composition of this invention generally comprises first applying the bleaching liquor to the fibre material, normally by immersion or, preferably, by padding e.g. in the temperature range from 10° to 60° C., but preferably at room temperature (15° to 25° C.), to a pick-up of about 50 to 120% by weight, preferably 90 to 100% by weight, after pinching-off. After it has been impregnated, the fibre material is subjected, without drying, in the still wet state to a moist storage treatment in which the material is rolled up and packed airtight in plastic sheeting and stored under normal pressure or under pressure at a maximum temperature of 150° C. for about 10 minutes, preferably, however, under normal pressure at 80° to 98° C. for about 1 to 5 hours or, most preferably, at room temperature (15° to 25° C.) for about 10 to 30 hours.

The treatment of the fibre material may, however, also be carried out in a long liquor (exhaust method) at a liquor to goods ratio of e.g. 1:3 to 1:100, preferably of 1:8 to 1:25, in the temperature range from 20° C. to 100° C., preferably from 80° to 98° C., for about ¼ hour to 3 hours under normal conditions, i.e. under atmospheric pressure in conventional apparatus, e.g. on a jigger or winch beck.

If appropriate, however, exhaustion can also be effected in the temperature range up to 150° C., preferably from 105° to 140° C., under pressure in high temperature (HT) apparatus.

For industrial application, continuous methods are of particular interest.

It is best not to exceed treatment temperatures of 98° C. so as to avoid damage to the fibre. However, in special HT apparatus the fibre material can also be treated in industrial continuous processes under pressure, e.g. up to 2.5 bar, at elevated temperature, e.g. up to 150° C., provided the treatment time is sufficiently brief to rule out damage to the fibre.

Subsequently the fibre material is normally rinsed thoroughly first with hot water of about 90° to 98° C. and then with warm and, finally, with cold water, neutralized with e.g. acetic acid, if necessary, and then wrung out and dried at elevated temperature (e.g. up to 150° C.).

The cellulosic material to be treated can be in a wide range of presentation, e.g. as loose material, yarn, wovens or knits. The material is thus normally always in the form of textile fibre materials which are made from pure textile cellulosic fibres or from blends of textile cellulosic fibres and textile synthetic fibres.

Suitable cellulosic fibres are for example those made from regenerated cellulose, e.g. viscose rayon and viscose, from natural cellulose such as hemp, linen, jute and, in particular, cotton, while suitable synthetic fibres are those made from polyacrylonitrile and, in particular, from polyester and polyamide.

Material made of cotton or regenerated cellulose, or cotton/polyester and cotton/polyamide blends are especially suitable for treatment according to the invention, with cotton wovens and knits being particularly preferred. Materials which have been prewashed with e.g. surfactants are also suitable. It is also possible to bleach sized cotton fibres, in which case bleaching is carried out after or before sizing.

The fibre materials treated with the composition of this invention are free from husks, they have good rewettability and a low ash content and, in particular, they have an excellent degree of whiteness. The cellulose or cellulosic component of the bleached material exhibits no damage and no appreciable diminution in the degree of cellulose polymerisation. The use of the composition of this invention effects a particularly high degree of stabilisation, especially in bleaching liquors with a pH above 11. The original content of available oxygen of the bleaching liquor is retained for some considerable time (e.g. up to 5 days) or decreases only insignificantly (e.g. by about 10%). The bleaching effect is none the less excellent. The liquors are thus stable in respect of their content of available oxygen and can be used for some considerable time. Despite the fairly high content of component (c) (silicate, especially sodium silicate), the composition of this invention causes no, or scarcely any, incrustation of the bleaching apparatus and forms no deposits on the treated material. A material advantage of the composition of the invention is its particularly good storage stability over several months.

In the following Examples, parts and percentages are by weight.

EXAMPLE 1

With stirring, 79 parts of sodium hydroxide flakes are added over 10 minutes to 667 parts of a solution (A) consisting of 70% of an 35% aqueous solution of sodium silicate ($SiO_2$ content: 26%),
3% of the disodium salt of a 1-benzyl-2-heptadecylbenzimidazoledisulfonic acid (in powder form), and
27% of water, whereupon the reaction mixture exotherms to 55° C.

With stirring, 208 parts of a solution (B) consisting of

17% of a 50% aqueous solution of diethylenetriaminepenta(methylenephosphonic acid),
15.5% of sodium gluconate,
5.5% of magnesium chloride hexahydrate, and
62.0% of water are added at 55° C. over 15 minutes to the above reaction mixture.

After addition of solution (B), the temperature of the reaction mixture rises to 48° C. To the reaction mixture are then added 79 parts of sodium hydroxide flakes over 10 minutes, whereupon the reaction mixtures exotherms to 63° C.

The reaction mixture is cooled to 20° C., affording 1033 parts of a composition comprising (a) 1.72% of diethylenetriaminepenta(methylenephosphonic acid) in the form of the sodium salt,
(b) 3.12% of sodium gluconate,
(c) 15.82% of sodium silicate,
(d) 15.30% of sodium hydroxide,
(e) 1.10% of magnesium chloride hexhydrate,
(f) 1.94% of the disodium salt of a 1-benzyl-2-heptadecylbenzimidazoledisulfonic acid, and 61.00% of water.

After 5 months it was not possible to detect the slightest turbidity of the completely homogeneous composition.

EXAMPLE 2

The procedure of Example 1 is repeated except for using a solution (B) consisting of 18.6% of an aqueous solution containing 40% of the pentasodium salt of diethylenetriaminepentaacetic acid,
15.5% of sodium gluconate,
5.5% of magnesium chloride hexahydrate, and
60.4% of water, to give 1033 parts of a composition comprising (a) 1.50% of the pentasodium salt of diethylenetriaminepentaacetic acid,
(b) 3.12% of sodium gluconate,
(c) 15.82% of sodium silicate,
(d) 15.30% of sodium hydroxide,
(e) 1.10% of magnesium chloride hexahydrate, (f) 1.94% of the disodium salt of a 1-benzyl-2-heptadecylbenzimidazoledisulfonic acid, and 61.22% of water.

After 5 months storage it was not possible to detect the slightest turbidity of the completely homogeneous composition.

EXAMPLE 3

With stirring, 12 parts of potassium hydroxide and then 50 parts of sodium hydroxide are dissolved over 10 minutes in 670 parts of a solution (A) consisting of 93 parts of water, 24 parts of the disodium salt of a 1-benzyl-2-heptadecylbenzimidazoledisulfonic acid, and 553 parts of an 35% aqueous solution of sodium silicate ($SiO_2$ content: 26%), whereupon the temperature rises to 55° C. To the reaction mixture are then added, with stirring, 208 parts of a solution (B) consisting of 5.3% of a 50% aqueous solution of monomeric 1-hydroxyethane-1,1-diphosphonic acid, 15.5% of sodium gluconate, 5.5% of magnesium chloride hexahydrate, and 73.5% of water.

After the addition of solution (B), the temperature of the reaction mixture is 50° C. Then 60 parts of sodium hydroxide are dissolved in the reaction mixture over 10 minutes, whereupon the temperature rises to 68° C. The mixture is cooled to 20° C., affording 1000 parts of a composition comprising (a) 0.55% of monomeric 1-hydroxyethane-1,1-diphosphonic acid, (b) 3.22% of sodium gluconate, (c) 19.36% of sodium silicate, ($d_1$) 1.20% of potassium hydroxide, ($d_2$) 11.00% of sodium hydroxide, (e) 1.14% of magnesium chloride hexahydrate, (f) 2.40% of the disodium salt of a 1-benzyl-2-heptadecylbenzimidazoledisulfonic acid, and 61.13% of water.

The composition is homogeneous after 2 months storage at room temperature.

EXAMPLE 4

The procedure of Example 3 is repeated except for using 1.2% of sodium hydroxide as component ($d_1$) instead of 1.2% of potassium hydroxide, affording 1000 parts of a composition comprising (a) 0.55% of monomeric 1-hydroxyethane-1,1-diphosphonic acid, (b) 3.22% of sodium gluconate, (c) 19.36% of sodium silicate, (d) 12.20% of sodium hydroxide, (e) 1.14% of magnesium chloride hexahydrate, (f) 2.40% of the disodium salt of a 1-benzyl-2-heptadecylbenzimidazoledisulfonic acid, and 61.13% of water.

The composition has good storage stability.

EXAMPLE 5

Natural cotton fabric is padded with an aqueous bleaching liquor containing 25 g/l of the aqueous composition of Example 1, 1.6 g/l of sodium pentadecane-1-sulfonate, 0.5 g/l of an adduct of 4 moles of ethylene oxide and 1 mole of a mixture of decyl and lauryl alcohol, and 20 m/l of an aqueous 35% solution of hydrogen peroxide, and pinched off to a pick-up 100%. The fabric is then steamed for 10 minutes at 100° C. and immediately afterwards rinsed first with hot water (90° to 98° C.) and then with cold water. The fabric is then neutralised by washing off with a dilute aqueous solution of acetic acid, wrung out and finally dried at 100° C.

The treated cotton fabric is free from husks and has excellent rewettability. The increase in whiteness of the bleached fabric compared with the untreated fabric before bleaching is determined by the CIBA-GEIGY whiteness scale [q.v. R. Griesser, "Tenside Detergents", Vol. 12, No. 2, pp. 93–100 (1975)]. The untreated fabric has a value of −43, compared with a value of +62 for the bleached fabric. The average degree of polymerisation of the bleached fabric is only insignificantly lower than that of the unbleached fabric. After treatment the residual peroxide content is still 41%. This bleaching liquor can be used for further bleaching treatments. The liquor can normally no longer be used if the concentration of hydrogen peroxide has fallen to below 20%. However, if a composition that does not contain a magnesium complex of components (a) and (e) is not added to the bleaching liquor, then the hydrogen peroxide present in the liquor will decompose spontaneously and almost completely. The residual peroxide content after bleaching will in this case be only 2%.

Similar results are also obtained by padding desized, still moist cotton fabric wet in wet with an aqueous concentrated bleaching liquor to a pick-up of 20%, which liquor contains 125 g/l of the aqueous composition of Example 1 and 100 ml/l of 35% aqueous of hydrogen peroxide, and subsequently steaming, rinsing, neutralising, wringing out and drying the fabric as described above; or treating natural cotton fabric on a winch beck by the exhaust method in a liquor to goods ratio of 1:40 for 15 minutes at 90° C. in bleaching liquor containing 12 g/l of the aqueous composition of Example 2, 2 g/l of sodium hydroxide, 0.3 g/l of sodium pentadecane-1-sulfonate, 0.1 g/l of an adduct of 4 moles of ethylene oxide and 1 mole of a mixture of decyl and lauryl alcohol, and 20 ml/l of a 35% aqueous solution of hydrogen peroxide, and subsequently rinsing, neutralising, wringing out and drying the fabric as described above; or padding natural cotton fabric to a pick-up of 100% with an aqueous bleaching liquor containing 25 g/l of the composition of Example 1, 7 g/l of sodium hydroxide, 1.6 g/l of sodium pentadecane-1-disulfonate, 0.5 g/l of an adduct of 4 moles of ethylene oxide aand 1 mole of a mixture of decyl and lauryl alcohol, and 50 m/l of a 35% aqueous solution of hydrogen peroxide, rolling up and packing the impregnated fabric airtight in plastic sheeting and storing it for 24 hours at room temperature (15°–25° C.), and then rinsing, neutralising, wringing out and drying the fabric as described above.

EXAMPLE 6

An untreated cotton/polyester blend (35:65) is impregnated in a bleaching bath containing 25 g/l of the aqueous composition of Example 3, 20 m/l of an aqueous 35% solution of hydrogen peroxide, 1.6 m/l of sodium pentadecane-1-sulfonate, and 0.5 g/l of an adduct of 4 moles of ethylene oxide and 1 mole of a mixture of decyl and lauryl alcohol, and pinched off to a pick-up of 90%.

The impregnated fabric is then steamed for 5 minutes at 100° C. and subsequently washed for 1 minute hot and 1 minute cold, neutralised and dried.

The degree of whiteness of the treated blend is increased by the bleaching process for 0 to 55 CIBA-GEIGY whiteness units. After treatment, they hydrogen peroxide content is still 58% of the original value.

The bleached fabric is virtually undamaged by the bleaching process. The average degree of polymerisation is 2760 before bleaching and 2690 after bleaching.

What is claimed is:

1. An aqueous composition for use in bleaching which comprises (a) an aminopoly(alkylenephosphonic acid), an alkanepolyphosphonic acid, an alkali metal salt of a polyaminocarboxylic acid, or a mixture of an alkanepolyphosphonic acid and an alkali metal salt of a polyaminocarboxylic acid, (b) a polyhydroxy compound, (c) an alkali metal silicate, (d) an alkali metal hydroxide, (e) a magnesium salt selected from the group consisting of magnesium acetate, magnesium sulfate and magnesium chloride, and (f) an effective stabilizing amount of an alkali metal salt of benzyl ($C_8$–$C_{22}$) alkylbenzimidazoledisulfonic acid an alkyldisulfonic acid, aryldisulfonic acid or alkaryldisulfonic acid as anionic dispersant.

2. A composition of claim 1, wherein component (a) is selected from the group consisting of an aminobis($C_1$–$C_3$alkylenephosphonic acid), an aminotris($C_1$–$C_3$alkylenephosphonic acid), a diaminotetra(methylenephosphonic) acid which is derived from a saturated, aliphatic or cycloaliphatic hydrocarbon of 2 to 6 carbon atoms, a triaminopenta(methylenephosphonic acid) which is derived from a saturated, aliphatic or cycloaliphatic hydrocarbon of 2 to 6 carbon atoms, a $C_1$–$C_4$alkanediphosphonic acid which is substituted by hydroxy, amino, $C_1$–$C_4$alkylamino or $C_1$–$C_4$dialkylamino, $C_1$–$C_4$alkanetriphosphonic acid which is substituted by hydroxy, amino, $C_1$–$C_4$alkylamino or $C_1$–$C_4$dialkylamino, and an alkali metal salt of a polyaminocarboxylic acid containing 1 to 3 nitrogen atoms and 3 to 5 carboxymethyl groups or 1 carboxymethyl group and 2 hydroxyethyl groups.

3. A composition of claim 2, wherein component (a) is aminobis(methylenephosphonic acid), aminotris(methylenephosphonic acid), aminotris(ethylenephosphonic acid) or aminotris(isopropylenephosphonic acid).

4. A composition of claim 2, wherein component (a) is ethylenediaminetetra(methylenephosphonic acid), 1,2- or 1,3-diaminopropanetetra(methylenephosphonic acid), 1,3-diamino-2-hydroxypropanetetra(methylenephosphonic acid), 1,2-diaminocyclohexane(methylenephosphonic acid), 1-aminomethyl-2-aminocyclopentane tetra(methylenephosphonic acid), 1,2-bis(aminomethyl)cyclobutanetetra(methylenephosphonic acid), bis(ethylenediamino)sulfidotetra(methylenephosphonic acid), diethylenetriaminepenta(methylenephosphonic acid) or dipropylenetriaminepenta(methylenephosphonic acid).

5. A composition of claim 2, wherein component (a) is 1-hydroxyethane-1,1-disphosphonic acid, 1-aminoethane-1,1-diphosphonic acid, 1-hydroxyethane-1,1,2-triphosphonic acid or 1-hydroxypropane-1,1,3-triphosphonic acid.

6. A composition of claim 2, wherein component (a) is an alkali metal salt of ethylenediaminetetraacetic acid, diethylenetriaminepentaacetic acid, nitrolotriacetic acid, N-hydroxyethylethylenediaminetetraacetic acid, N,N-bis(2-hydroxyethyl)glycine or 1,3-diamino-2-propanoltetraacetic acid.

7. A composition of claim 1, wherein component (b) is a polyhydroxy compound of the formula

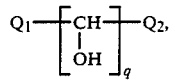

wherein each of $Q_1$ and $Q_2$ independently of the other is —$CH_2OH$, —CHO or —COOM, where M is hydrogen or an alkali metal, and q is an integer from 2 to 5.

8. A composition of claim 7, wherein component (b) is a hydroxycarboxylic acid of the formula

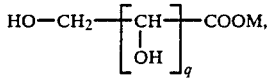

or a lactone thereof.

9. A composition of claim 8, wherein component (b) is gluconic acid, an alkali metal salt thereof or the gamma-lactone thereof.

10. A composition of claim 1, wherein component (c) is sodium silicate.

11. A composition of claim 1, wherein component (d) is potassium hydroxide or sodium hydroxide.

12. A composition of claim 1, wherein component (f) is the disodium salt of an alkyldisulfonic acid of 8 to 20 carbon atoms.

13. A composition of claim 1, wherein component (f) is the sodium salt of a condensate of 2 to 3 moles of a naphthalenesulfonic acid and 1 or 2 moles of formaldehyde.

14. A composition of claim 1, wherein component (f) is the disodium salt of a benzyl($C_8$–$C_{22}$)alkylbenzimidazoledisulfonic acid.

15. A composition of claim 1 which comprises 0.1 to 2.0% by weight of component (a), 0.4 to 8.0% by weight of component (b), 5.0 to 20.0% by weight of component (c), 9.0 to 21.0% by weight of component (d), 0.05 to 2.0% by weight of component (e), 0.5 to 3.0% by weight of component (f), and 44.1 to 84.95% by weight of water, based on the total weight of said composition.

16. A process for the preparation of a composition of claim 1, which comprises adding half the total amount of component (d) to an aqueous solution (A) of components (c) and (f), then adding an aqueous solution (B) containing components (a), (b) and (e) to solution (A), and finally adding the remaining half of component (d) to the mixture of solutions (A) and (B).

17. A process of claim 16, which comprises mixing solution (A) with half of component (d) and then with solution (B), and finally with the remaining half of component (d) at a temperature not exceeding 80° C.

18. A process of pretreating cellulosic fibers comprising the step of treating said cellulosic fibers with an aqueous liquor that contains a per compound and a composition of claim 1 as a bleaching activator and bleaching stabilizer.

19. A process for bleaching cellulosic fibers which comprises treating said fibers with an aqueous liquor that contains at least one per compound and a composition of claim 1.

20. An aqueous liquor for bleaching cellulosic fibers which liquor contains a per compound and a composition of claim 1.

* * * * *